US010034555B1

(12) United States Patent
Van den Akker

(10) Patent No.: US 10,034,555 B1
(45) Date of Patent: Jul. 31, 2018

(54) FOLDABLE RESTAURANT AND PUBLIC EATING AREA HIGH CHAIR

(71) Applicant: Lazy Baby, LLC, Venice, CA (US)

(72) Inventor: John Ross Van den Akker, Hermosa Beach, CA (US)

(73) Assignee: Lazy Baby, LLC, Venice, CA (US)

( * ) Notice: Subject to any disclaimer, the term of this patent is extended or adjusted under 35 U.S.C. 154(b) by 0 days.

(21) Appl. No.: 15/977,906

(22) Filed: May 11, 2018

Related U.S. Application Data

(63) Continuation-in-part of application No. 14/628,265, filed on Feb. 22, 2015.

(51) Int. Cl.

| | |
|---|---|
| ***A47D 1/02*** | (2006.01) |
| ***A47B 83/02*** | (2006.01) |
| ***A47C 4/00*** | (2006.01) |
| ***A47C 4/02*** | (2006.01) |
| ***A47D 1/00*** | (2006.01) |
| ***A47C 4/38*** | (2006.01) |

(52) U.S. Cl.
CPC ..... *A47D 1/023* (2017.05); *A47C 4/02* (2013.01); *A47C 4/38* (2013.01); *A47D 1/00* (2013.01); *A47D 1/006* (2013.01); *A47D 1/008* (2013.01)

(58) Field of Classification Search
CPC . A47D 1/02; A47D 1/023; A47D 1/00; A47D 1/006; A47D 1/008; A47D 1/002; A47D 3/005; A47C 4/02; A47C 4/028; A47C 4/38; A47C 12/02; A47C 13/00; A47B 3/02
USPC ..... 297/16.1, 16.2, 23, 47, 56, 148–156
See application file for complete search history.

(56) References Cited

U.S. PATENT DOCUMENTS

| | | | | |
|---|---|---|---|---|
| 169,748 | A | 11/1875 | Wakefield | |
| 188,324 | A | 3/1877 | Weller | |
| 940,582 | A | 11/1909 | Burrowes | |
| 1,587,253 | A * | 6/1926 | Tarbox | A47D 1/002 297/154 |
| 2,517,004 | A | 8/1950 | Ve Little et al. | |
| 2,574,387 | A * | 11/1951 | Guthmann | A47C 4/24 297/56 |
| 2,580,178 | A | 12/1951 | Kvarnstrom | |
| 2,627,300 | A | 2/1953 | Wohler et al. | |
| 2,649,141 | A * | 8/1953 | Marshall | A47C 4/14 297/56 X |

(Continued)

OTHER PUBLICATIONS

Graco Baby, Slim Spaces Highchair, http://www.gracobaby.com/en-US/highchairs/slim-spaces%3Csup%3E-trade%3B%3C-sup%3E-highchair, accessed Apr. 23, 2018.

*Primary Examiner* — Rodney B White
(74) *Attorney, Agent, or Firm* — SoCal IP Law Group LLP; Guy L. Cumberbatch; Steven C. Sereboff

(57) ABSTRACT

A restaurant and public eating area high chair is a high chair intended for use by infants and small children in restaurants and public eating areas. A restaurant and public eating area high chair consists of two front legs, two back legs, a seat, a backrest, a front bar, and side rails that are high enough to keep the child from falling off of the seat. The foldable restaurant and public eating area high chair is comprised of the same parts as prior art restaurant and public eating area high chairs, but is built in such a way so that it can fold flat. Folding flat makes the restaurant and public eating area high chair easy to carry, easy to store, and safer to use than prior art restaurant and public eating area high chairs.

20 Claims, 11 Drawing Sheets

(56) References Cited

U.S. PATENT DOCUMENTS 2,777,503 A * 1/1957 Grace ..... A47D 1/02 297/56 X
2,781,080 A * 2/1957 Pavlicek ..... A61G 5/00 297/56
2,851,086 A 9/1958 Weiner
3,012,815 A * 12/1961 Smith ..... A47D 1/002 297/153
3,025,101 A * 3/1962 McKinnie ..... A47B 3/02 297/56 X
3,072,433 A 1/1963 Heller
3,086,812 A * 4/1963 Eads ..... A47D 1/002 297/30
3,345,105 A * 10/1967 Levy ..... A47D 1/002 297/149
3,425,744 A * 2/1969 Epstein ..... A47D 1/002 297/19
4,036,523 A * 7/1977 Nielsen ..... A47D 1/004 297/56 X
4,095,843 A * 6/1978 Hirsch ..... A47D 1/004 297/136
4,273,379 A * 6/1981 Borichevsky ..... A47C 4/02 297/56 X
4,278,287 A 7/1981 Homestead
4,938,603 A * 7/1990 Turner ..... A47D 1/02 297/16.1 X
5,104,180 A * 4/1992 Takahashi ..... A47D 1/02 297/16.1 X
5,123,697 A * 6/1992 Szczurek ..... A47C 9/005 297/23 X
5,165,755 A * 11/1992 Rho ..... A47D 1/004 297/56 X
5,707,104 A * 1/1998 Perego ..... A47D 1/002 297/16.1
6,129,414 A * 10/2000 Brevi ..... A47D 1/002 297/16.1
6,347,830 B1 * 2/2002 Chen ..... A47D 1/02 297/16.1 X
6,655,731 B2 * 12/2003 Martin ..... A47C 1/023 297/23
6,863,341 B1 * 3/2005 Wen ..... A47C 1/124 297/23
6,938,952 B2 9/2005 Dauterive
7,128,367 B2 10/2006 You et al.
7,334,836 B2 * 2/2008 Chen ..... A47D 1/02 297/16.1 X
7,441,835 B2 * 10/2008 Chen ..... A47D 1/002 297/16.1
7,600,810 B2 * 10/2009 Chen ..... A47D 1/02 297/56 X
7,703,843 B2 * 4/2010 Chen ..... A47D 1/02 297/56 X
7,753,448 B2 * 7/2010 Chen ..... A47D 1/002 297/16.1
7,878,583 B2 2/2011 Buckavich et al.
3,002,343 A1 8/2011 Song et al.
8,371,645 B2 * 2/2013 Lin ..... A47C 4/04 297/23
9,844,278 B2 * 12/2017 Winterhalter ..... A47D 1/02
2006/0125293 A1 * 6/2006 Yeh ..... A47D 1/002 297/16.1
2007/0040420 A1 * 2/2007 Li ..... A47D 1/002 297/16.1 X
2007/0069566 A1 * 3/2007 Li ..... A47D 1/002 297/16.1 X
2007/0144831 A1 * 6/2007 Cole ..... A47C 12/02 182/33
2007/0194609 A1 * 8/2007 Chen ..... A47D 1/02 297/16.1
2007/0194614 A1 8/2007 Chen et al.
2007/0290527 A1 * 12/2007 Chen ..... A47D 1/02 297/16.1
2007/0290528 A1 12/2007 Chen et al.
2008/0179921 A1 * 7/2008 Lake ..... A47D 1/008 297/16.2
2009/0273212 A1 * 11/2009 Leng ..... A47C 4/14 297/56
2012/0242114 A1 * 9/2012 Boucquey ..... A47C 4/10 297/16.1 X
2015/0289674 A1 * 10/2015 Winterhalter ..... A47D 1/02 297/16.1

* cited by examiner

FOLDABLE RESTAURANT AND PUBLIC EATING AREA HIGH CHAIR

RELATED APPLICATION INFORMATION

This application is a continuation in part of application Ser. No. 14/628,265, filed Feb. 22, 2015, titled "Collapsible Restaurant and Public Eating Area High Chair," which is incorporated herein by reference.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

FIELD OF THE INVENTION

The present invention relates to high chairs used for seating infants and toddlers in restaurants and public eating areas.

BACKGROUND

The present disclosure will refer to restaurant and public eating area high chairs as restaurant high chairs and it will be assumed that they are also intended for use in public eating areas. References to high chairs designed to be used in homes and not marketed for use in restaurants are as home high chairs.

High chairs are used to seat infants and toddlers at a level where they can be fed by an adult or at a level so that when the high chair is pushed up to a table, the child is able to use the table surface. Most home high chairs include a permanent or detachable tray for the child to use and do not require a table or additional surface for the child. High chairs used in restaurants usually resemble the one shown in FIG. 5. This design is popular because it is simple, safe, and stackable. Most restaurant high chairs do not contain a tray because it would take up more space, be harder to clean, and be more difficult to store.

Refer to FIG. 5. Prior art restaurant high chairs usually resemble the one shown in FIG. 5 and consist of a frame formed by two front legs 31 and two back legs 32 connected at the base by two horizontal support pieces 39. The horizontal support pieces 39 aid in stability, joint durability, and ease of stacking. The front legs 31 and back legs 32 often have additional support pieces 33 connecting both front legs 31 and back legs 32. Some prior art restaurant high chairs have a footrest 34, which provides extra structural support. The front legs 31 and back legs 32 support a flat seat 36, a backrest 38, two side railings 40, and a front bar 41 to ensure that the child does not fall out. The front bar 41 may have a crotch strap 37 connected to the front of the seat 36 that goes in between the child's legs, so that the child does not slide under the front bar 41.

Prior art restaurant high chairs, like the one shown in FIG. 5, are safe for children, easy to use, and stackable. However, they are difficult to carry, take up a large amount of space when stored, and break easily.

Because prior art restaurant high chairs do not fold, they are difficult to carry. Unlike home high chairs, which are often left in one place or stored near where they are regularly used, restaurant high chairs must be stored out of the dining space and moved to and from tables as necessary during meal service. Other prior art includes a high chair similar to the one in FIG. 5 without the horizontal support pieces 39 connecting the front legs 31 with the back legs 32. This version claims to be easier to carry, such that when carrying the high chair on a person's side, the horizontal support pieces 39 would have to rest against the person's leg. Without these pieces, carrying the high chair is supposed to be more ergonomic, however, it neglects to consider that the person carrying the high chair would have to walk partially between the front legs 31 and back legs 32, which could result in tripping and injury.

Additionally, restaurant high chairs must be stored in areas that are often difficult to access, like restrooms or storage areas located away from the dining room. Transporting high chairs from these areas is inefficient and inconvenient for employees seating customers. Seating tables quickly is important because it positively affects restaurant sales and improves customer service. In most restaurants, if a high chair is needed, the request is relayed from a host, or a similarly positioned employee, to another employee who must walk to where high chairs are stored, carry one back to a table, and then walk back to the host, or the similarly positioned employee, who is then able to seat the customer.

Finally, prior art restaurant high chair designs are not generally conducive to safe storage. Prior art restaurant high chairs are often stored in tall stacks, with each placed vertically on top of one another. Stacks of high chairs can easily reach five or more feet. In addition, this kind of stacking requires the bottom of the high chair to be lifted high enough to clear the top of a single or previously stacked high chair. At times this height can exceed the height of the person stacking the high chairs. Moreover, it is easy for hands and fingers to get pinched in between restaurant high chairs while they are being stacked.

Some attempts at making folding home high chairs have been made, such as seen in U.S. Pat. No. 2,851,086, and also the Graco Baby Slim Spaces High Chair (http://www.gracobaby.com) sold by Newell Brands of Hoboken, N.J. However, these designs are intended to be purchased individually and are not designed to be stored alongside multiple units. Additionally, they are either not robust enough for constant public use or have a complicated construction and thus there is a need for a simpler and more durable foldable high chair for use in restaurants.

SUMMARY OF THE INVENTION

The present invention is intended to provide restaurants and public eating areas with a foldable high chair that is easy and safe to carry, convenient to store, and safe for a child to use.

Refer to FIGS. 1-4. The present invention contains two resting forms. The resting forms are herein referred to as: opened FIG. 1 and folded FIGS. 2-4. This present invention identifies a restaurant high chair FIG. 1 as a chair intended for use by an infant or toddler wherein two front legs 11 and two back legs 10 support a seat 17 with a backrest 14, a front bar 16, and side rails that are high enough to keep the child from falling off of the seat. Here, the upper portion of the front legs 11 create the side rails. The seat 17 is at a height that allows the child to use a table when the front bar 16 is pushed against it. A crotch strap 18 may connect the front bar 16 to the front of the seat 17, passing between the child's legs to keep the child from sliding under the front bar 16. The present invention also includes a seatbelt that is not shown.

The high chair's depth is less than six inches thick when folded FIG. 2. This distance is measured between the outer side of the front legs 11 and outer side of the back legs 10. When folded, the high chair can be lifted by the front bar 16.

From an ergonomic standpoint, lifting an item with a center of mass that is close to one's body is both safe and easy. By holding the folded restaurant high chair close to one's body, it can be lifted with one's legs, reducing the risk of back injury, and a restaurant employee can easily grab and transport the folded restaurant high chair while walking without stopping.

Storage of the high chair is both convenient and safe. In contrast to non-foldable chairs, the high chair can be stacked horizontally, instead of vertically FIG. 6. When stacked horizontally, transport is easy and safe because it does not require the high chair to ever be lifted more than a few inches off of the floor. In addition, the option to stack horizontally, as opposed to vertically, reduces the risk of pinching, or otherwise injuring, fingers. This is because when stacking horizontally, each high chair is resting on the floor, and only a portion of the high chair's weight is resting on each additional horizontally stacked high chair.

Storage is also more convenient because once the high chair is folded it occupies a much smaller amount of floor space. This allows for more discrete placement throughout restaurants (for example, next to a host stand or a service counter), and the folded chair's slim profile allows for many chairs to be stacked without obstructing views or reducing the aesthetic appeal of the space.

Most importantly, the disclosed invention is safe for the child. Once the child is on the seat 17, the downward force exerted by the child's weight keeps the high chair from folding. This is especially important in a restaurant or public eating area environment, as there is the possibility of a caretaker retrieving the high chair with little or no experience operating one. In addition, when the crotch strap 18 is connected to the seat 17, the movable joints are locked in place.

Lastly, the high chair will remain sturdy and undamaged over time because, unlike non-foldable models, stacking horizontally does not subject joints to additional wear.

BRIEF DESCRIPTIONS OF THE DRAWINGS

DETAILED DESCRIPTION OF THE INVENTION

Figure 2:
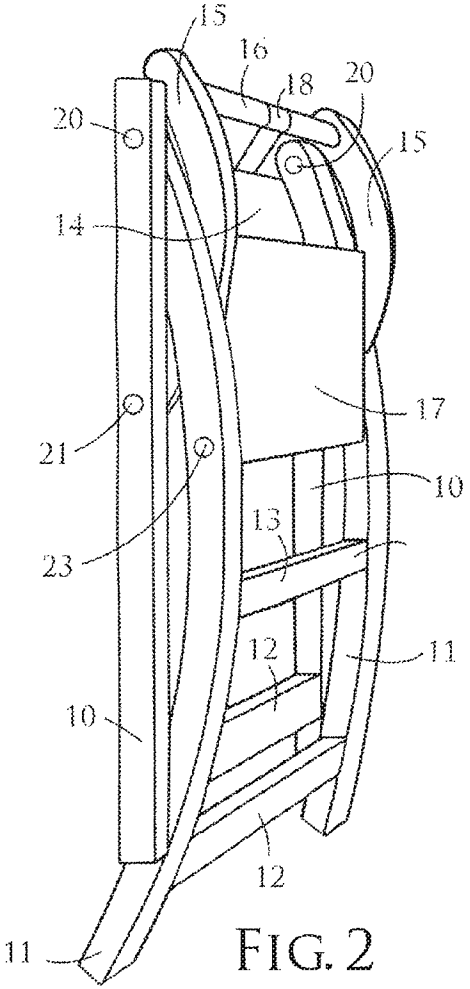
FIG. 2 is a perspective view of the high chair in its folded form standing upright.

Refer to FIGS. 1-4. As defined by the text and drawings in the present disclosure, a restaurant and public eating area high chair contains two front legs 11, two back legs 10, a seat 17 with a backrest 14, a front bar 16, and side rails that are high enough to keep the child from falling out of the seat 17; here, the side rails are created by the top portion of the front legs 11. Not shown is a seat belt connected to the seat that buckles and tightens over the child's waist. When the high chair is opened and placed so that the front bar 15 meets the edge of a table, the child is able to use the table surface.

The present invention has parts that are joined by both permanent joints and moveable joints. The permanent joints connect parts of the high chair that remain fixed in the opened and folded forms. The permanent joints are: the horizontal support bar 12 connecting both of the back legs 10, the horizontal support bar 12 and foot rest 13 connecting both of the front legs 11, the front bar 16 connecting to the front bar supports 15, and the backrest 14 connecting to both back legs 10. The moveable joints connect parts of the high chair that change position in relation to one another in the opened and folded forms. These joints are represented in FIGS. 1-4 by 20, 21, 22, 23. These joints allow for a pivoting motion connecting the back legs 10 and front bar supports 15, the back legs 10 and front legs 11, the front bar supports 15 and seat 17, and the front legs 11 and seat 17. Pivotal joint movement resulting from external force causes the different parts of the high chair to move in a circular motion in relation to one another.

Figure 1:
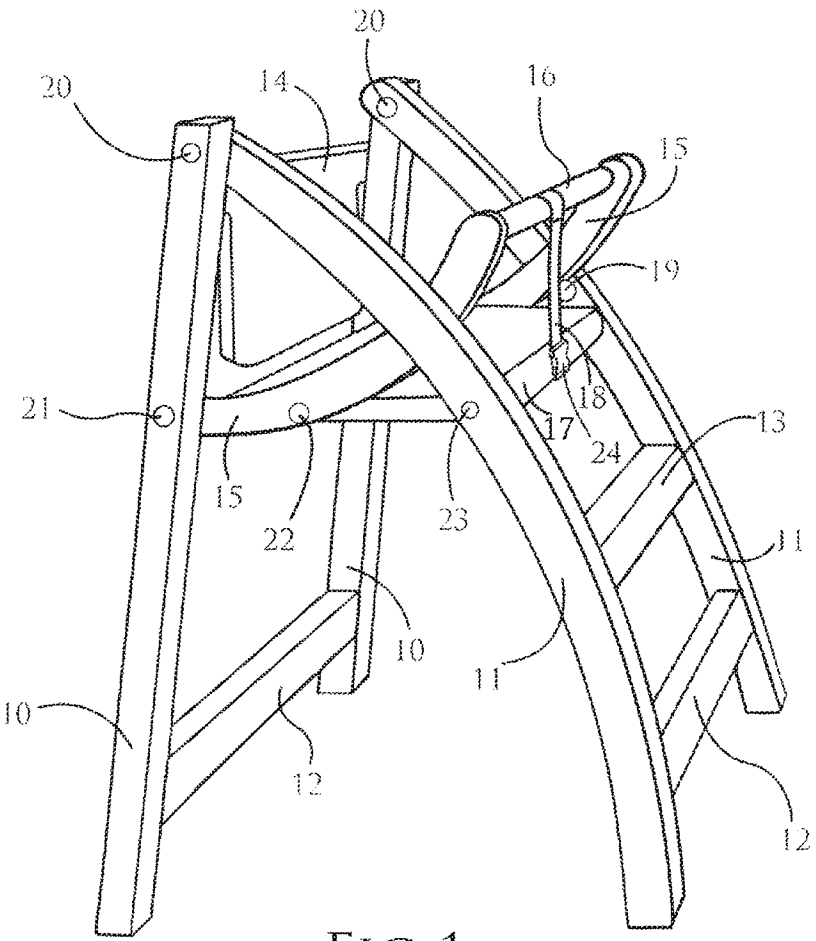
FIG. 1 is a perspective view of the high chair in its opened form standing upright.

Assume that the quick-release buckle 24 connecting the crotch strap 18 to the seat 17 is connected when the high chair is in its opened form FIG. 1. To change from the opened form FIG. 1 to the folded form FIGS. 2-4, the child must first be removed from the high chair. Then, the quick release buckle 24 connecting the crotch strap 18 to the seat 17 must be unbuckled. Once unbuckled, one can place one's hand on the backrest 14 and another hand on the front bar 16. While tilting the high chair on its front legs 10 and pulling the front bar 16 back towards the top of the backrest 14, the seat 17 rotates forward ninety degrees, until it is perpendicular with the floor. When the seat 17 has rotated forward ninety degrees, the high chair has reached its folded form FIGS. 2-4. In its folded form, the front legs 11 touch the horizontal support bar 12 that is connected to the back legs 10 while the front bar supports 15 touch the top of the backrest 14. Refer to FIG. 3. At this point, the crotch strap 18 can be re-buckled to the second female quick release buckle 25 that is permanently connected to the back of the backrest 14, securing the high chair in its folded form.

Figure 4:
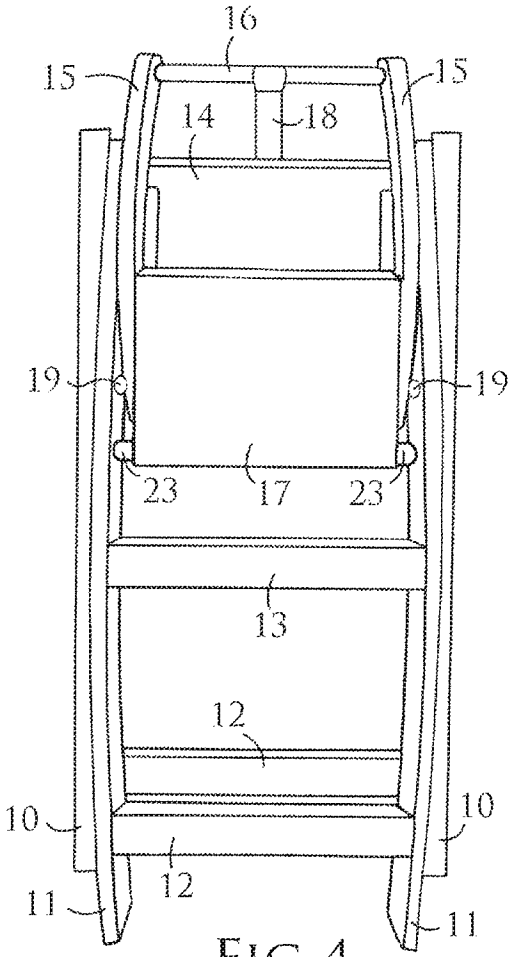
FIG. 4 is a front view of the high chair in its folded form standing upright.
Figure 3:
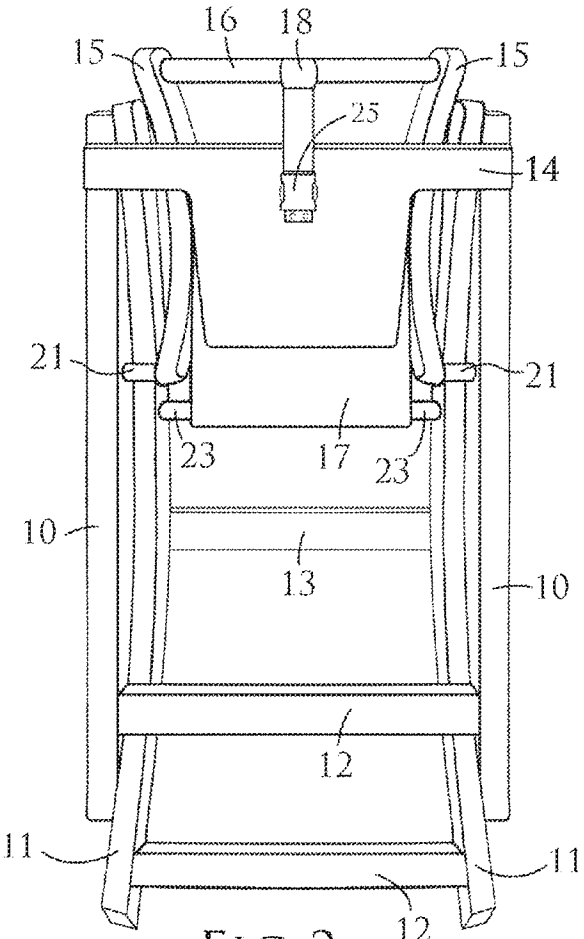
FIG. 3 is a back view of the high chair in its folded form standing upright.
Figure 6:
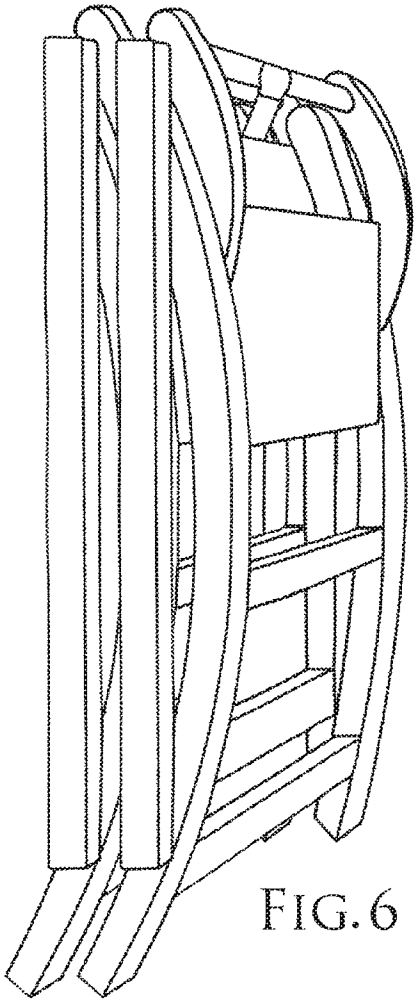
FIG. 6 is a perspective view of two of the currently-disclosed restaurant high chairs horizontally stacked standing upright in their folded configurations.
Figure 5:
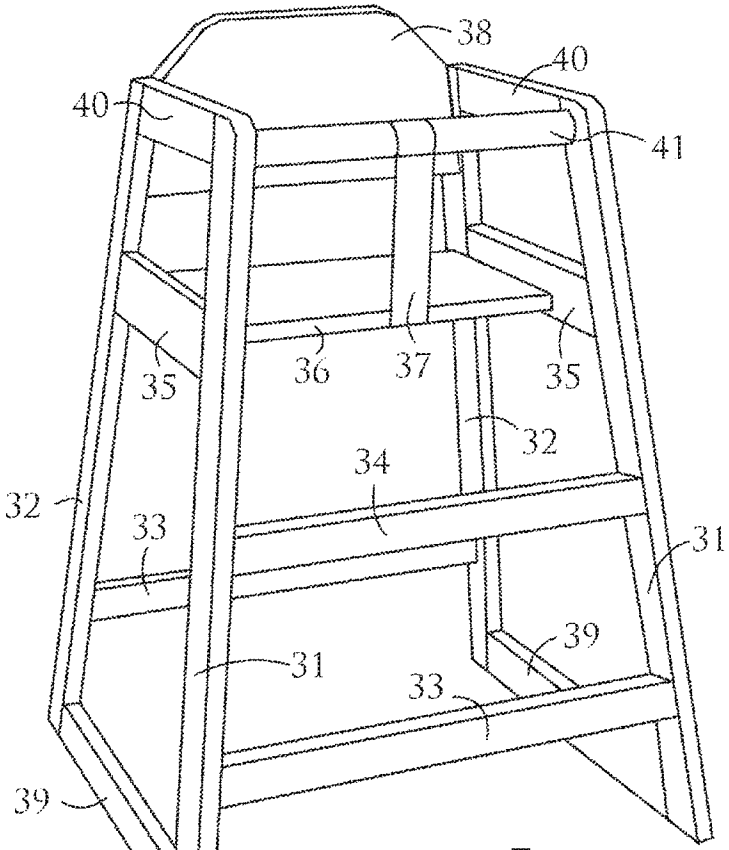
FIG. 5 (PRIOR ART)
FIG. 5 is a perspective view of a prior art restaurant high chair standing upright.

Refer to FIGS. 2-4. Assume the quick release buckle 24 connecting the crotch strap 18 to the backrest 14 is connected when the high chair is in its folded form. To change from the folded form FIGS. 2-4 to the opened form of FIG. 1, the high chair must be placed close to where it is intended for use. Once placed, the quick release buckle 25 connecting the crotch strap 18 to the backrest 14 must be unbuckled. At this point, one can place one's hand on the backrest and another hand on the front bar 16. While balancing the high chair on its front legs 11 and pushing the front bar away from the backrest 14, the seat 17 is forced to rotate ninety degrees back, until it is parallel with the floor as in FIG. 1. As the seat 17 rotates, the bottom of the back legs 10 and the bottom of the front legs 11 are forced apart. Once the seat 17 has rotated ninety degrees, the back legs 11 and front legs 10 are at their maximum distance from each other, and the back legs 10 can be rested on the floor. To ensure that the seat 17 does not continue to rotate forward past ninety degrees, there are front bar support stoppers 19 that protrude from the inside of the upper portion of the front legs 11.

Refer to FIG. 1. The rotating joints 21 and the rotating joints 23 are the pivot points of a circular motion, where the rotating joints 21 and the rotating joints 23 rotate around the rotating joints 22. Since the distance between the rotating joints 21 and the rotating joints 22 are stationary, and the distance between the rotating joints 22 and the rotating joints 23 is stationary, when the rotating joints 21 and the rotating joints 23 are at their farthest from each other, the high chair has reached its opened form, and cannot open anymore FIG. 1. At this point, the rotating joints 21, the rotating joints 22, and the rotating joints 23 converge into a straight line. When the disclosed invention is collapsing, the rotating joints 21 and the rotating joints 23 are pushed towards each other, pivoting around the rotating joints 22. At this point, the back legs 10 and the front legs 11 move together and the seat 17 rotates forward, until it reaches its folded form. FIGS. 2-4.

When the restaurant high chair is opened, the distance of the crotch strap 18, from the front bar 16 to the female end of the quick release buckle 24, is the same as the distance from the front bar 16 to the female end of the quick release buckle 25 on the back of the backrest 14 when the restaurant high chair is closed. This allows the crotch strap 18 to be buckled and unbuckled in both the opened form FIG. 1 and folded form FIGS. 2-4 without having to adjust length of the crotch strap 18.

When a child is using the high chair, it must be in its opened form of FIG. 1. When open, the crotch strap connects from the front bar 16 to the front of the seat 17 with a quick release buckle 24. When the high chair is opened FIG. 1, the crotch strap 18 must be fastened to the female end of the quick release buckle 24. This protects the child from sliding under the front bar 16. This also protects the child by ensuring that the high chair does not fold while moving the child to and from the seat. After disconnecting the crotch strap 18 from the front seat 17, the chair can be folded. Once folded, the crotch strap 18 is connected to the female end of the quick release buckle 25 on the back of the backrest 14. This keeps the high chair in its folded form when not in use. When folded as in FIG. 2, the crotch strap keeps the high chair from opening by connecting to the female end of the quick release buckle 25 on the back of the backrest 14 FIG. 3.

Figure 7B:
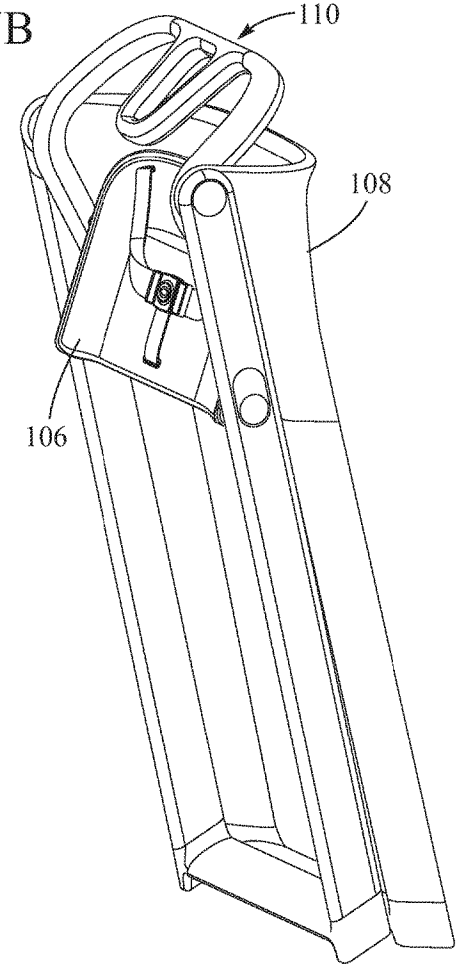
FIGS. 7A and 7B are opened and folded frontal perspective views of an alternative high chair in accordance with the principles disclosed herein.
Figure 7A:
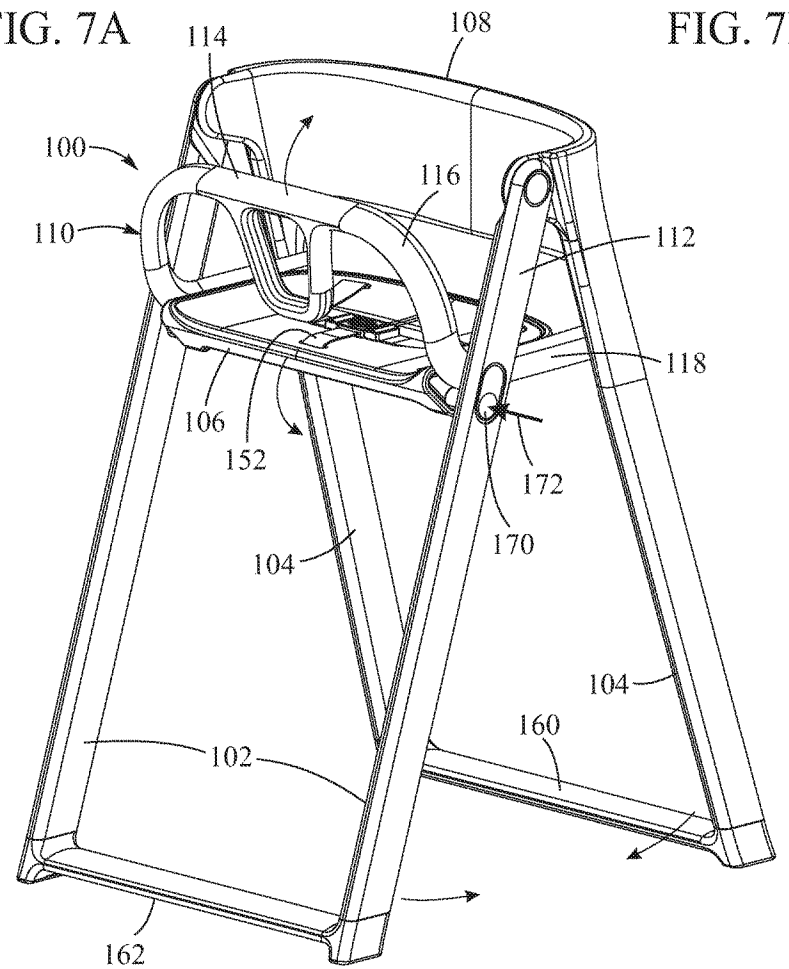
Figures 7C, 7D:
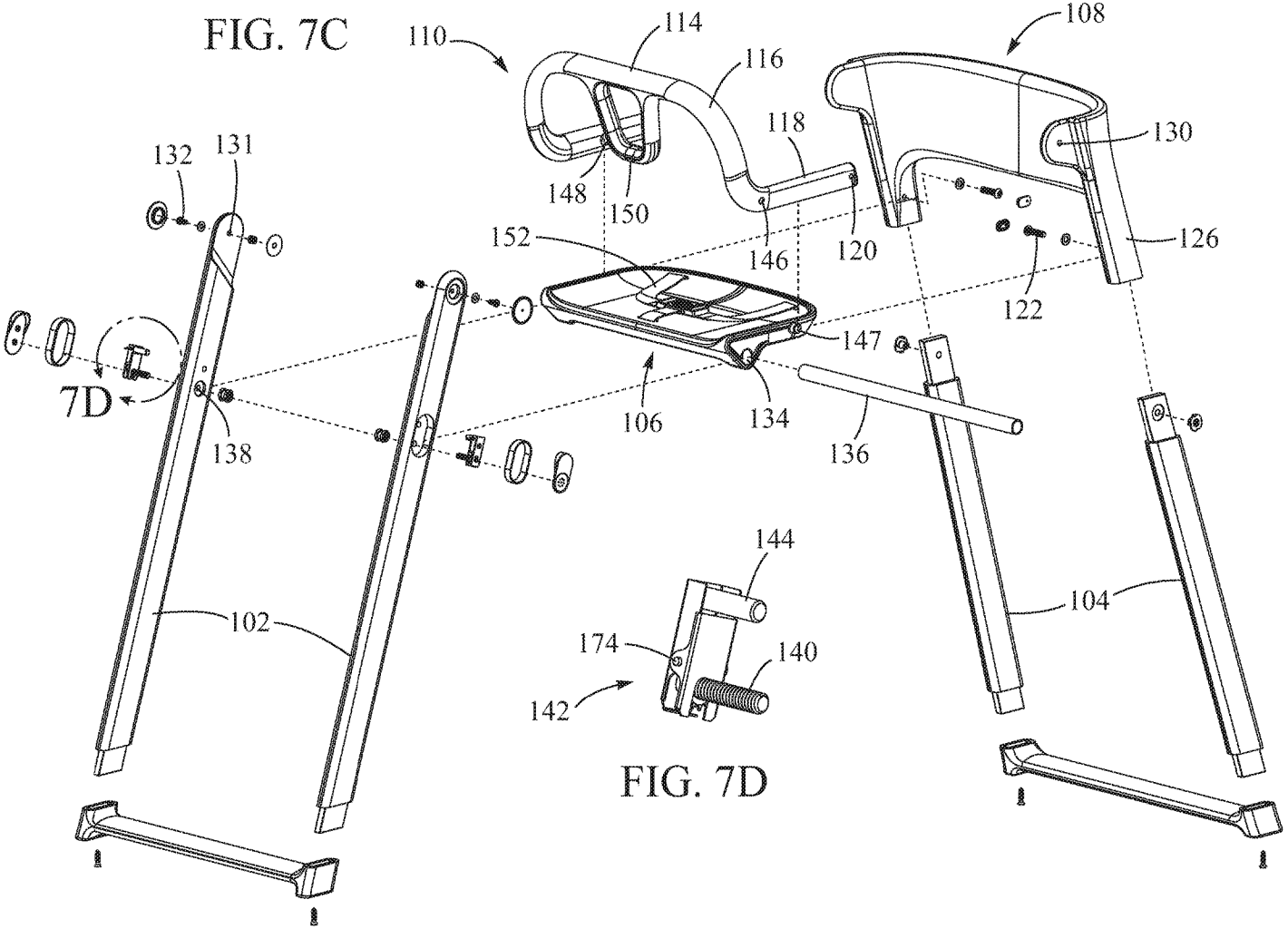
FIG. 7C is an exploded perspective view of the alternative high chair.
FIG. 7D is an enlarged perspective view of a locking mechanism.
Figure 8B:
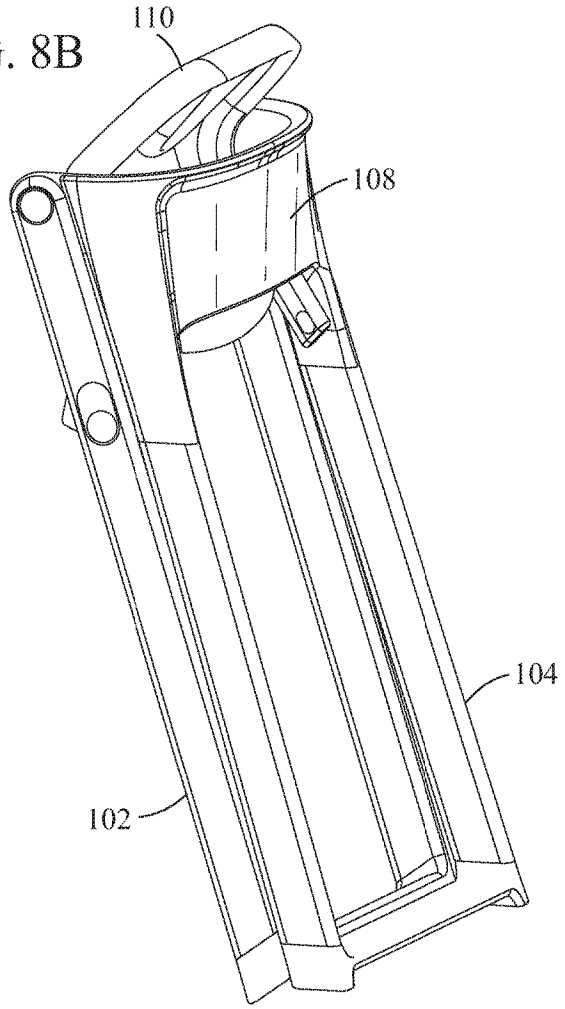
FIGS. 8A and 8B are opened and folded rear perspective views of the alternative high chair.
Figure 8A:
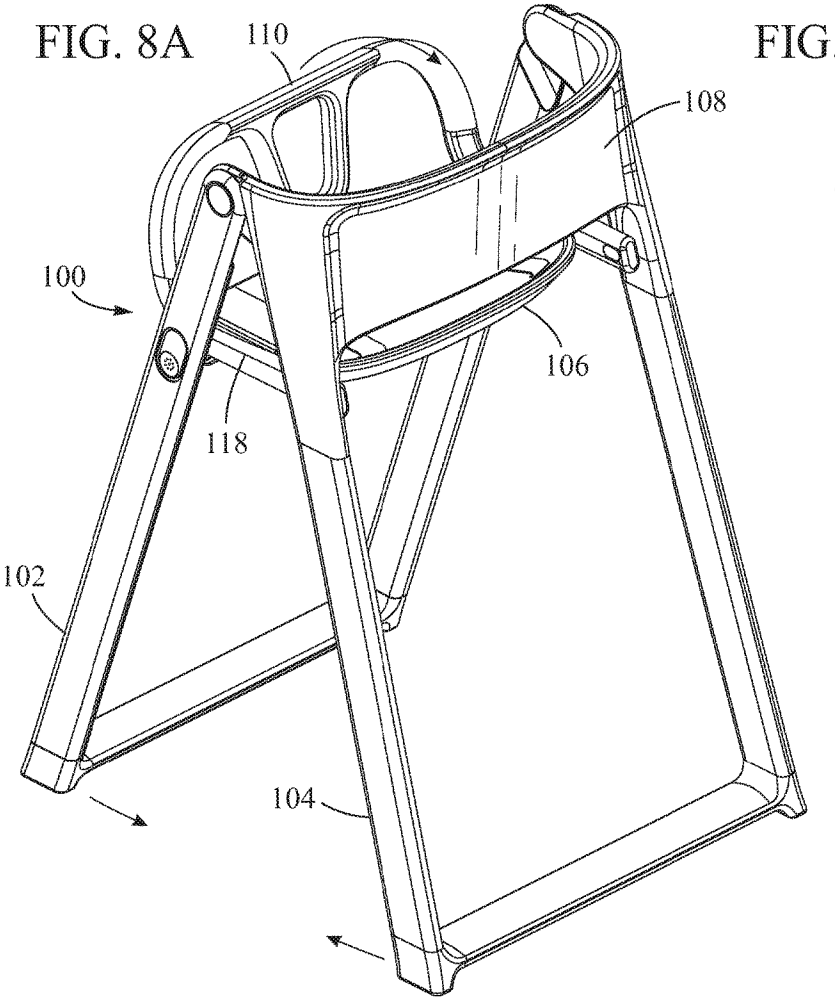
Figure 9B:
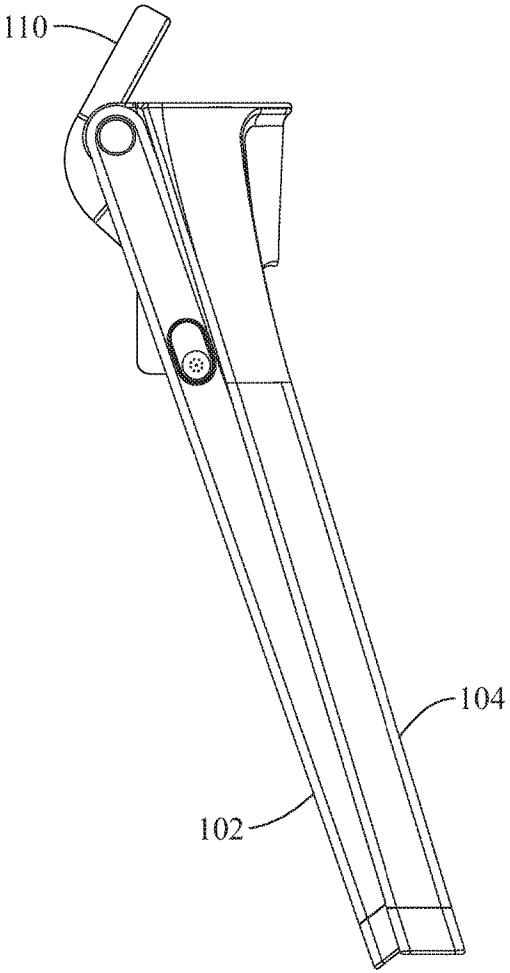
FIGS. 9A and 9B are opened and folded left side elevational views of the alternative high chair.
Figure 9A:
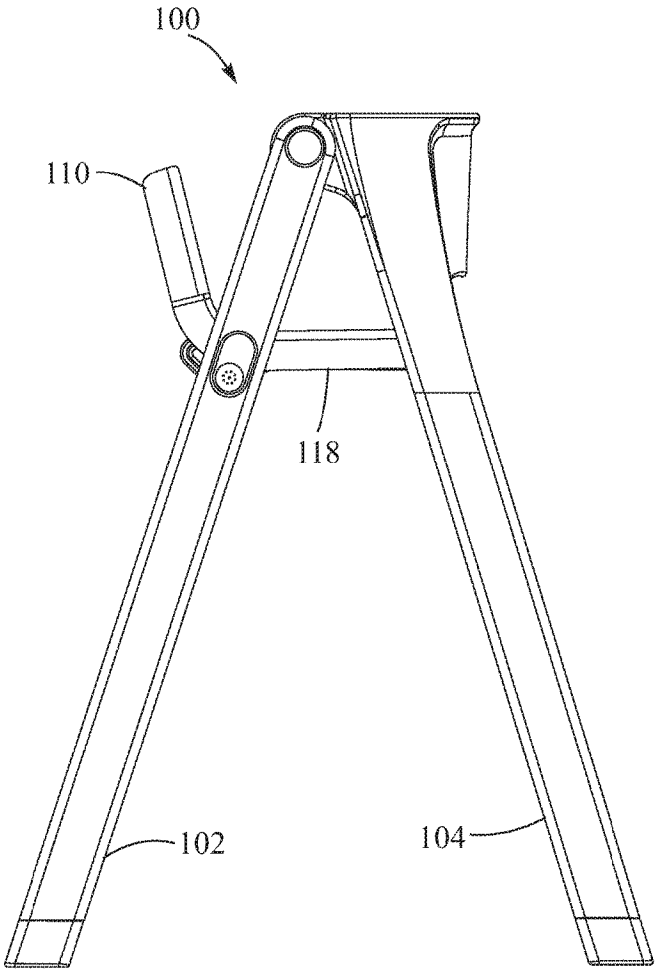

FIGS. 7A and 7B are opened and folded frontal perspective views of an alternative high chair 100 in accordance with the principles disclosed herein, and FIG. 7C is an exploded perspective view of the alternative high chair. FIGS. 8A and 8B are opened and folded rear perspective views of the alternative high chair 100 and FIGS. 9A and 9B are opened and folded left side elevational views of the alternative high chair. In general, the alternative high chair 100 folds and functions much like the first-disclosed high chair, though the aforementioned crotch strap 18 is replaced by a solid guard. Further, all edges and corners have been rounded so as to be less angular and thus more comfortable and safe for the child as well as the worker who handles the chair.

As with the earlier embodiment, the alternative high chair 100 contains two resting forms: opened as shown in FIGS. 7A/8A/9A and folded as shown in FIGS. 7B/8B/9B. This alternative high chair 100 is a chair intended for use by an infant or toddler wherein two front legs 102 and two back legs 104 support a seat 106 with a backrest 108, a front bar 110, and side rails 112 that are high enough to keep the child from falling off of the seat. As before, the upper portion of the front legs 102 create the side rails 112. The seat 106 is at a height that allows the child to use a table when the front bar 110 is pushed against it.

As seen in the opened state of FIG. 7A and in the exploded view of FIG. 7C, the front bar 110 includes a generally horizontal front portion 114 that extends laterally and smoothly bends downward at corners 116 and then bends into two arms 118 that extend rearward to pivoting connections with the back legs 104. FIG. 7C shows a through hole 120 in one of the arms 118 which is engaged by a pivot bolt 122 connecting the front bar arms 118 to the rear legs 104. An upward movement arrow in FIG. 7A indicates the direction that the front bar 110 pivots when the chair converts from the open state to the folded state.

As seen best in in FIG. 7C, the backrest 108 merges into upper ends of the back legs 104 via a molded shape that includes a laterally-extending back portion 124 that curves forwards at each side to form a pair of front-to-back-oriented side portions 126. The side portions 126 define upper ends of the back legs 104 which are in the form of elongated struts below the backrest 108. Two forwardly-directed flanges 128 commonly molded with and extending from the side portions 126 provide structure to form one-half of an upper pivot joint 130 between the front legs 102 and the back legs 104 (the other half of the pivot joint 130 being formed by upper ends 131 of the front legs 102). Pivot bolts 132 and associated fastening hardware are shown adjacent the upper ends of the front legs 102 in FIG. 7C.

Still with reference to FIG. 7C as well as the detail of FIG. 7D, the seat 106 is also an ergonomically-molded part with slightly upwardly curved edges around all but the front edge to define a bucket of sorts. A pair of downwardly-projecting enlargements 134 at the front corners of the seat 106 provide through holes for a support bar 136 that is in turn secured at either end within recesses 138 formed on the insides of the front legs 102. Fastening bolts 140 extend inward from outside of the legs 102 to secure the support bar 136 in place. The fastening bolts 140 each attach to a locking element 142 having an inwardly-directed pin 144 that aligns with and projects inward through an aperture in the corresponding front leg 102. The pin 144 interacts with a hole 146 in the outside of one of the front bar arms 118 to lock the chair 100 in the open position, as will be explained below with reference to FIGS. 12A-12C.

The seat 106 also has a pair of outwardly-projecting shaft stubs 147 on both lateral sides at a location near its back edge. The shaft stubs 147 insert and pivot within similarly shaped recesses 148 formed on laterally inside surfaces of both arms 118 of the front bar 110. The recesses 148 are located roughly at the midpoint from front-to-rear of the arms 118. The shaft stubs 147 and recesses 148 are aligned and define a middle one of three lower joints of the high chair 100 as will be explained below.

In place of a crotch strap 18, as in the first embodiment, the alternative high chair 100 has a centered, generally U-shaped guard 150 extending down from the horizontal front portion 114 of the front bar 110 to a location near the front of the seat 106. This guard 150 projects down between the child's legs to keep the child from sliding under the front bar 110. The front bar 110 and guard 150 are each formed with smoothly curved surfaces and bends to protect the child from any injury due to impact or the child struggling to break free.

The present invention also preferably includes a seatbelt that is shown at 152 in FIGS. 7A and 7C.

Figure 10:
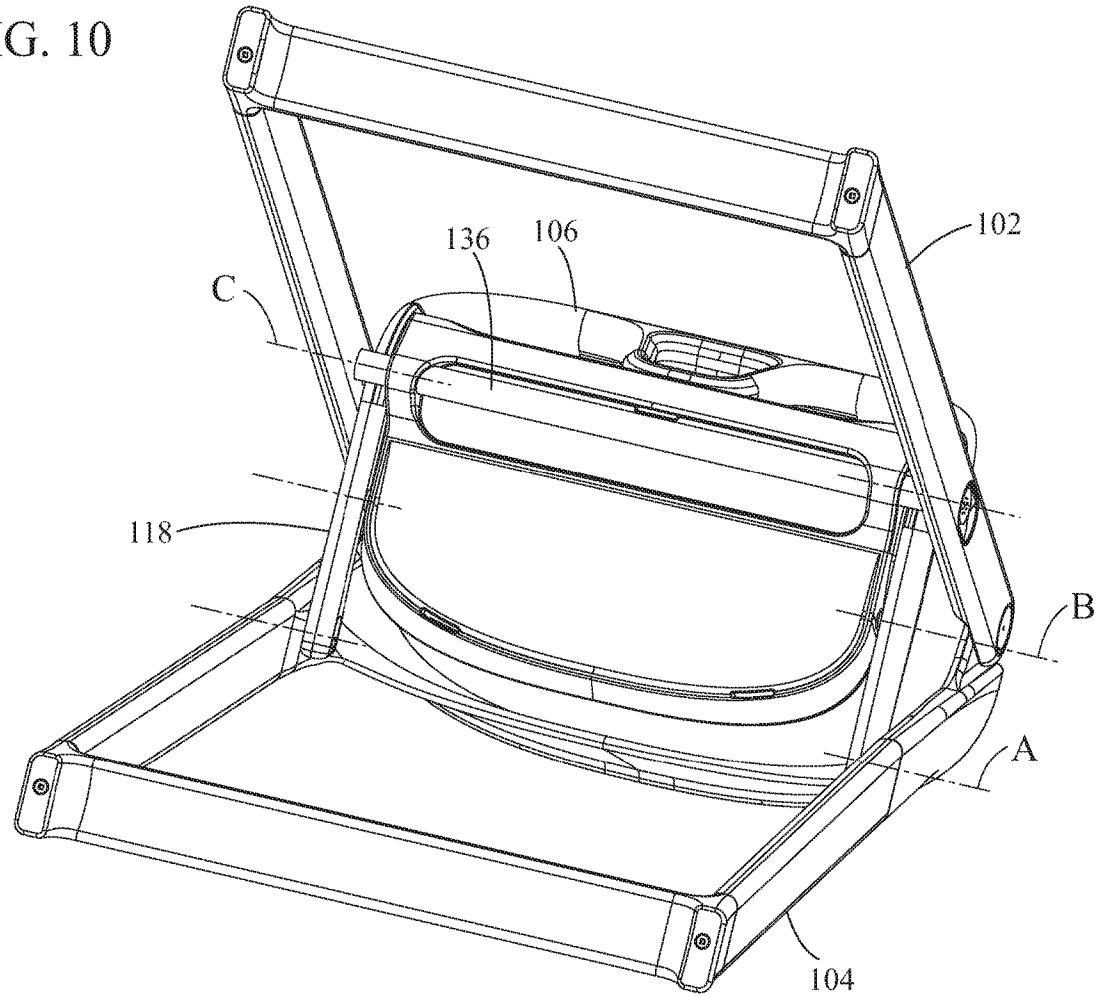
FIG. 10 is an underneath perspective view of the alternative high chair.
Figure 11B:
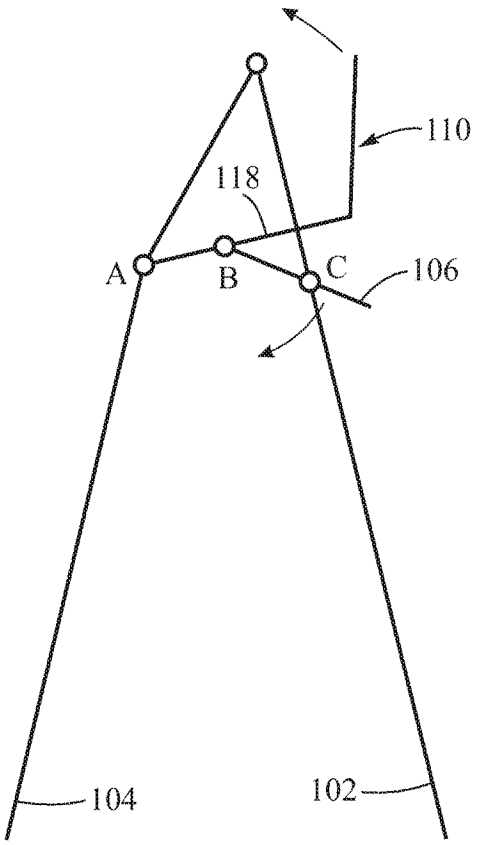
FIGS. 11A-11D are schematic views of a folding mechanism of the alternative high chair with FIG. 11A showing the schematic folding mechanism superimposed over a right side elevational view of the chair.
Figure 11A:
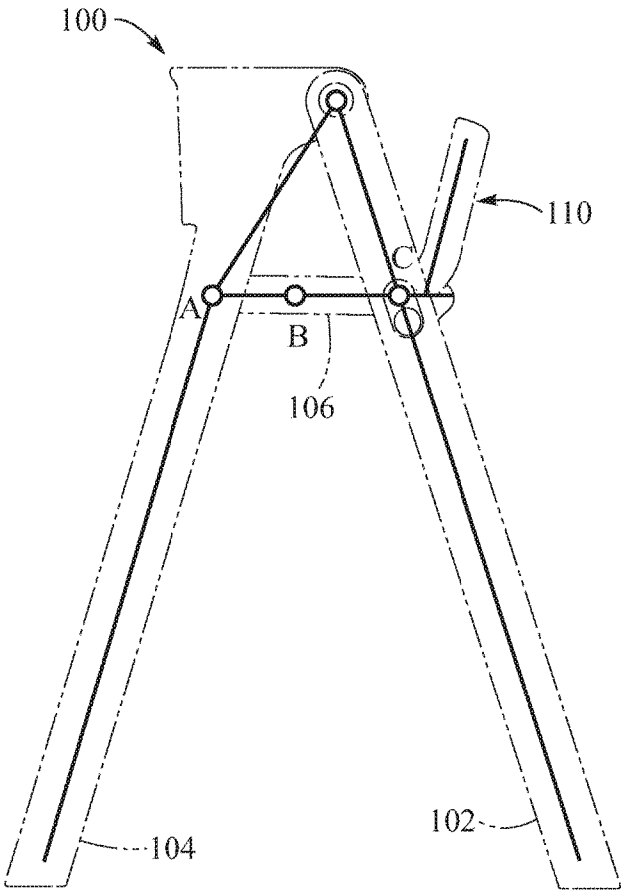

FIG. 10 is an underneath perspective view of the alternative high chair 100 illustrating three horizontal axes defined by relatively pivoting parts of the high chair. FIGS. 11A-11D are schematic views of a collapsible architecture of the alternative high chair 100 with FIG. 11A showing the schematic folding mechanism superimposed over a right side elevational view of the chair.

As with the first disclosed embodiment, and with reference back to FIGS. 7-9, the alternative high chair 100 has parts that are joined by both permanent joints and moveable joints. The permanent joints connect parts of the high chair that remain fixed in the opened and folded positions. The permanent joints are: a horizontal support bar 160 connecting lower ends of the back legs 104, a horizontal support bar 162 connecting lower ends of the front legs 102, and the backrest 108 connecting upper ends of both back legs 104.

The moveable joints connect parts of the high chair 100 that change position in relation to one another in the opened and folded forms. In addition to the upper pivot joint 130 between the front legs 102 and the back legs 104, these joints are represented in FIGS. 7-11 by the symbols A, B, C. Specifically as seen in FIGS. 11A and 11B, and the underside view of FIG. 10, the pivot joints include a rear joint A, a middle joint B and a front joint C. These joints allow for pivoting motion between the back legs 104 and front legs 102 (upper pivot joint 130), the back legs 104 and front bar arms 118 (rear joint A), the front bar arms 118 and seat 106 (middle joint B), and the front legs 102 and seat 106 (front joint C). Pivotal joint movement resulting from external force causes the different parts of the high chair 100 to move in a circular motion in relation to one another.

Figure 11D:
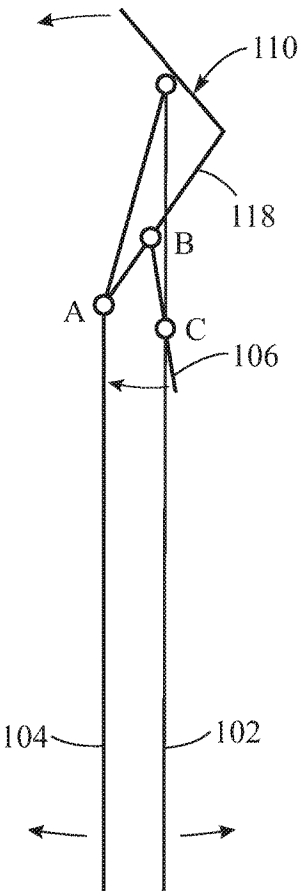

To change from the opened form of FIGS. 7A, 11A and 11B to the folded form of FIGS. 7B and 11D, the child must first be removed from the high chair. Then, quick-release buttons 170 are depressed on both sides of the front legs 102 to unlock the chair 100, as indicated by arrow 172 in FIG. 7A. With reference to FIG. 7D, the locking elements 142 each include a hinge 174 about which an outer portion rocks to alternate between a position where the pin 144 is pivoted inward into engagement with the hole 146 in the front bar 110 and a position where the pin is retracted from the hole, following depression of the associated button 170.

While quick-release buttons 170 are depressed, the operator can tilt the chair 100 on its front legs 102 or its back legs 104 and pull up on the front bar 110 back towards the top of the backrest 108 as seen from the right side of the chair in FIG. 11B, the front bar 110 rotates upward or CCW. By tilting the high chair onto its front legs 102 or its back legs 104, the legs are able to come together. This is because the weight of the chair 100 pushes the bottom ends of the front legs 102 and the bottom ends of the back legs 104 away from each other when it is resting in its opened form FIGS. 7A/8A/9A, thus keeping the high chair in its open position. When the weight of the high chair is removed from either both front legs 102 or both back legs 104, the non-weight-bearing legs can move freely about their pivot joint 130. By virtue of the seat 106 pivoting near its front end about the front legs 104 and about a mid-portion of the front bar arms 118 of the front bar 110, the seat 106 rotates forwardly or CW. This is helped by the forward rotational force applied to the seat 106 by the rising front bar 110, by virtue of the interaction of the shaft stubs 147 pivoting in the recesses 148 (FIG. 7C), about middle joint B.

Figure 11C:
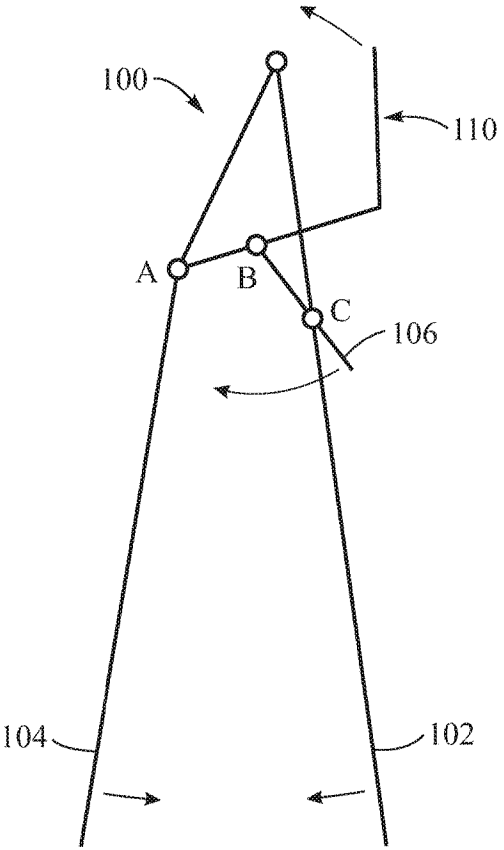

FIG. 11C shows further pivoting of the front bar 110 and seat 106, and FIG. 11D shows the entire chair 100 folded flat. Ultimately, the seat 106 rotates forward nearly ninety degrees, until it is perpendicular with the floor, as seen in FIG. 7B. When the seat 106 has rotated forward ninety degrees, the high chair has reached its folded form FIGS. 7B/8B/9B. In its folded form, the front legs 102 touch the horizontal support bar 160 that is connected to the back legs 104 while the front bar arms 118 touch the top of the backrest 108.

Conversely, to change from the folded form of FIGS. 7B/8B/9B to the opened form of FIGS. 7A/8A/9A, the high chair must be placed close to where it is intended for use. At this point, one can place one's hand on the backrest 108 and another hand on the front bar 110. While balancing the high chair on its front legs 102 and pushing the front bar away from the backrest 108, the seat 106 is forced to rotate ninety degrees back, until it is parallel with the floor as seen in FIG. 7A. As the seat 106 rotates, the bottom of the back legs 104 and the bottom of the front legs 102 are forced apart. Once the seat 106 has rotated ninety degrees, the back legs 102 and front legs 104 are at their maximum distance from each other, and the back legs 104 can be rested on the floor. The seat 106 will not continue to rotate forward past ninety degrees, as the front bar 110 contacts and is supported underneath by the support bar 136 under the seat 106 that in turn is connected at each end to the front legs 102. Additionally, the seat 106 is connected at middle pivot B to the horizontal arms 118 of the front bar 110, and so the seat 106 is fully supported. When in use, the weight of the high chair 100 pushes the bottom ends of the front legs 102 and the bottom ends of the back legs 104 away from each other when it is resting in its opened form FIGS. 7A/8A/9A. When the high chair 100 is in use, the weight of a child on the seat 106 further forces the high chair to remain open. Because the high chair requires no weight on either the front legs 102 or the back legs 104 in combination with an upward motion of the front bar 110 to fold shut, the risk of it unintentionally folding while in its opened form FIGS. 7A/8A/9A is eliminated.

Referring to FIGS. 11A-11D, the rotating joints A and the rotating joints C are the pivot points of a circular motion, where the rotating joints A and the rotating joints C rotate around the rotating joints B. Since the distance between the rotating joints A and the rotating joints B are stationary, and the distance between the rotating joints B and the rotating joints C is stationary, when the rotating joints A and the rotating joints C are at their farthest from each other, the high chair has reached its opened form, and cannot open anymore FIG. 11A. At this point, the rotating joints A, the rotating joints B, and the rotating joints C converge into a straight line. When the chair 100 is folding, the rotating joints A and the rotating joints C are pushed towards each other, pivoting around the rotating joints B. At this point, the back legs 104 and the front legs 102 move together and the seat 106 rotates forward, until it reaches its folded form, as in FIG. 11D.

Figure 12A:
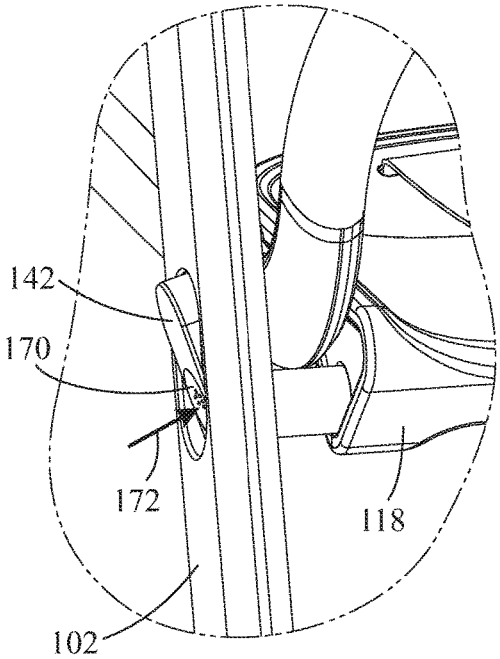
FIGS. 12A-12C are enlarged perspective views of a mechanism for locking the alternative high chair in the opened position.
Figure 12B:
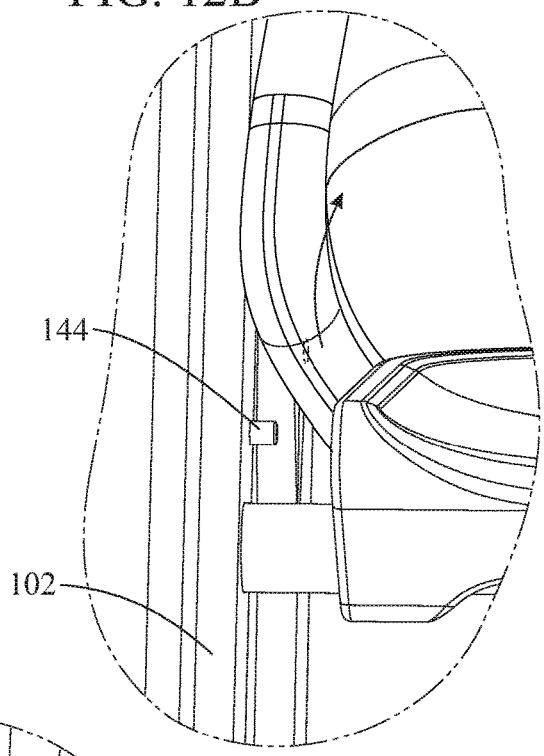
Figure 12C:
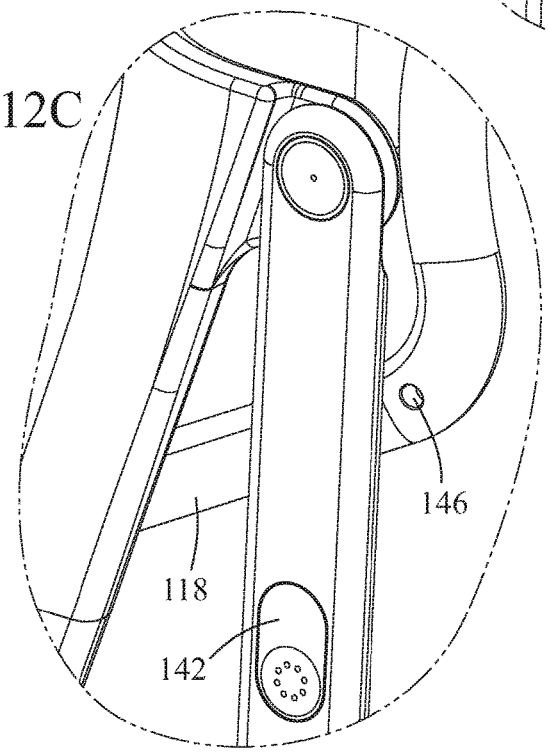

With reference to FIGS. 12A-12C, a mechanism for locking the alternative high chair in the opened position is shown. As mentioned above, the locking elements 142 secured to the outside of each front legs 102 each carry an inwardly-directed pin 144 that aligns with and projects inward through an aperture in the front leg. FIG. 12B shows one of the pins 144 projecting inward from the leg 102. The pins 144 interact with the holes 146 in the outside of the front bar arms 118 to lock the chair 100 in the open position. FIG. 12A shows inward depression of the quick-release button 170 on the locking element 142 to unlock the chair 100, as indicated by arrow 172.

Although not shown, a strap and buckles may be used to secure the high chair in its folded form. However, the alternative chair 100 desirably doesn't lock in the folded position. Friction and a slight over rotation keep the chair from opening when not in use. When the chair is in the open position, the locking pins 144 and holes 146 are a safety feature that keeps the chair from accidentally folding shut, but it is the weight of the child in the chair that actually keeps it open. In order to meet ASTM (https://www.astm.org) Standard Consumer Safety Specifications for High Chairs, a locking mechanism that keep a folding high chair in the open position, so that the chair doesn't accidentally get folded shut with a child using it.

It is important to reiterate the way in which a child sitting in the seat 106 holds the chair 100 in its open, unfolded position. As best seen in FIG. 7A, the front bar 110 rests on the support bar 136 (FIG. 7C) which acts as the pivot axis for the front edge of the seat 106. Thus, both the front edge of the seat 106 and the front corners of the front bar 110 are held up by the support bar 136 and in turn the front legs 102. At the same time, the rear ends of the arms 118 of the front bar 110 are supported by the pivot bolts 122 fixed through the rear legs 104. Thus, the front bar 110 is completely supported from downward movement at both front and rear ends. Seeing as the seat 106 is pivotally connected on both lateral sides to the midpoint of the front bar 110 (shaft stubs 147 inserted into recesses 148), weight on the seat resists lifting of the front bar 110. The chair 100 cannot collapse without the front bar pivoting upward, and thus the seat effectively locks the chair in the unfolded position. One must lift the child out of the seat 106 to fold the chair 100.

Additionally, the safety locking pins 144 that insert into the holes 146 in the outside of the front bar arms 118 are non-load-bearing. That is, the weight of the front arm 110 is borne by the fixed elevation support bar 136 under the front edge of the seat 106. Consequently, no weight is applied to the pins 144 when they are inserted into the holes 146.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

It is claimed:

1. A restaurant and public eating area high chair comprising:

two front legs pivotably connected at an upper pivot joint at upper ends to upper ends of two rear legs, the high chair having an open configuration where the front and rear legs are pivoted apart so that bottom ends thereof are spaced apart and a closed configuration in which the bottom ends are close together;

lateral front supports fixedly connecting the two front legs and lateral rear supports fixedly connecting the two rear legs, one of the lateral rear supports forming a backrest near the upper ends of the rear legs;

a front bar pivotably connected to even height locations on the rear legs about a first lateral axis, the front bar extending forward from the first lateral axis in two side arms connected by a horizontal bar extending laterally across the high chair and having a laterally centered barrier extending downward therefrom, wherein in the open configuration of the high chair the side arms of the front bar are substantially horizontal and in the closed configuration the front bar is pivoted upward such that the horizontal bar is located above the first lateral axis and in contact with the backrest; and a seat sized to support a child sitting thereon, the seat being pivotably connected to both of the side arms of the front bar along a second lateral axis and pivotably connected to even height locations on the front legs about a third lateral axis, wherein in the open configuration of the high chair the seat is substantially horizontal with the horizontal bar of the front bar extending above a front edge thereof and the barrier prevents a child sitting in the seat from sliding out forward off the seat, and in the closed configuration the seat is pivoted forward such that a rear edge of the seat is located above the front edge.

2. The high chair of claim 1, wherein the front legs angle upward above the seat on each side toward the upper pivot joint and form side rails high enough to keep the child from sliding laterally out of the chair while sitting in the seat.

3. The high chair of claim 1, wherein the barrier is formed by a rounded U-shaped bar that depends down from the horizontal bar of the front bar to a location close to the seat.

4. The high chair of claim 1, wherein the barrier is formed by a crotch strap that detachably connects the horizontal bar of the front bar to a connector on the seat.

5. The high chair of claim 1, wherein the backrest is a molded component that forms the upper ends of the rear legs.

6. The high chair of claim 1, wherein there are two lateral supports aside from the backrest, one connected between and at lower ends of the front legs and a second one connected between and at lower ends of the rear legs.

7. The high chair of claim 1, wherein one of the lateral supports is connected between the front legs at a height just below the seat so as to function as a footrest.

8. The high chair of claim 1, further including a locking mechanism for securing the high chair in the open configuration, including a quick-release button located on a laterally outside surface of one or both of the front legs.

9. The high chair of claim 8, wherein the locking mechanism includes a lock pin which alternately engages and disengages a hole in one or both of the side arms of the front bar.

10. The high chair of claim 9, wherein the lock pin is non-weight bearing when the chair is in its open configuration.

11. A restaurant and public eating area high chair comprising:

two front legs pivotably connected at an upper pivot joint at upper ends to upper ends of two rear legs, and a seat secured between the two front legs, the high chair having an open configuration where the front and rear legs and chair form an A-frame as seen from a side, and a closed configuration where the front and rear legs come together in a flattened vertical shape as seen from a side and the seat pivots to be substantially in line with the flattened shape;

a backrest extending between and fixedly connected near the upper ends of the rear legs;

a front bar pivotably connected to even height locations on the rear legs about a first lateral axis, the front bar extending forward from the first lateral axis in two side arms connected by a horizontal bar extending laterally across the high chair and having a barrier extending downward therefrom, wherein in the open configuration of the high chair the side arms of the front bar are substantially horizontal and in the closed configuration the front bar is pivoted upward such that the horizontal bar is located above the first lateral axis and in contact with the backrest; and a seat sized to support a child sitting thereon, the seat being pivotably connected to both of the side arms of the front bar along a second lateral axis and pivotably connected to even height locations on the front legs about a third lateral axis, wherein in the open configuration of the high chair the first, second and third lateral axes are substantially horizontally aligned with the second lateral axis located between the first and third lateral axes, and in the closed configuration the second lateral axis is located above the first lateral axis which is located above the third lateral axis.

12. The high chair of claim 11, wherein the front legs angle upward above the seat on each side toward the upper pivot joint and form side rails high enough to keep the child from sliding laterally out of the chair while sitting in the seat.

13. The high chair of claim 11, wherein the barrier is formed by a rounded U-shaped bar that depends down from the horizontal bar of the front bar to a location close to the seat.

14. The high chair of claim 11, wherein the barrier is formed by a crotch strap that detachably connects the horizontal bar of the front bar to a connector on the seat.

15. The high chair of claim 14, wherein the crotch strap doubles as a strap to hold the high chair in its folded form when coupled to a connector located behind the backrest.

16. The high chair of claim 11, wherein the backrest is a molded component that forms the upper ends of the rear legs.

17. The high chair of claim 11, further including lateral front supports fixedly connecting the two front legs and lateral rear supports fixedly connecting the two rear legs.

18. The high chair of claim 11, further including a locking mechanism for securing the high chair in the open configuration, including a quick-release button located on a laterally outside surface of one or both of the front legs.

19. The high chair of claim 18, wherein the locking mechanism includes a lock pin which alternately engages and disengages a hole in one or both of the side arms of the front bar.

20. The high chair of claim 19, wherein the locking mechanism is non-weight bearing when the chair is in its open configuration.

* * * * *